United States Patent [19]

Blake et al.

[11] 4,211,837

[45] Jul. 8, 1980

[54] PHOTOGRAPHIC SILVER HALIDE ELEMENT WITH OPAQUE BACKING LAYER

[75] Inventors: Ralph K. Blake, Westfield; James G. Morgan, Cranbury, both of N.J.; David W. Woodward, Kennett Sq., Pa.

[73] Assignee: E. I. Du Pont de Nemours and Company, Wilmington, Del.

[21] Appl. No.: 728,736

[22] Filed: Oct. 1, 1976

Related U.S. Application Data

[63] Continuation of Ser. No. 506,725, Sep. 17, 1974, abandoned.

[51] Int. Cl.[2] ..... G03C 1/76; G03C 1/84

[52] U.S. Cl. ..... 430/502; 430/510; 430/530

[58] Field of Search ..... 96/84 R, 84 M, 87 R, 96/87 A, 68

[56] References Cited

U.S. PATENT DOCUMENTS

| | | | |
|---|---|---|---|
| 1,434,453 | 11/1922 | Steel | 96/87 A |
| 3,269,252 | 8/1956 | Keyser et al. | 96/84 R |
| 3,511,660 | 5/1970 | Stevens et al. | 96/87 R |
| 3,793,029 | 2/1974 | Parker | 96/84 R |
| 3,881,952 | 5/1975 | Young | 96/76 R |
| 3,900,323 | 8/1975 | MacLeish et al. | 96/84 R |

*Primary Examiner*—Jack P. Brammer

[57] ABSTRACT

Removable opaque backing layers for photographic silver halide elements are described. The opaque backing layer contains carbon black and a scavenging agent for impurities of the carbon black selected from fine-rain photosensitive silver halides, silver nitrate, and halides of iron, zinc and mercury. The scavenger prevents the impurities from fogging the photographic silver halide emulsion layers of the elements.

9 Claims, No Drawings

PHOTOGRAPHIC SILVER HALIDE ELEMENT WITH OPAQUE BACKING LAYER

This is a continuation of application Ser. No. 506,725, filed Sept. 17, 1974, now abandoned.

BACKGROUND OF THE INVENTION

1. Field of the Invention

This invention relates to photographic film elements and more particularly to photographic elements coated on a support and having an opaque, protective backing layer coated thereon. Still more particularly, this invention relates to a photographic element containing an opaque, protective backing layer that can be removed in the fluids used during the processing step whereby the photographic element is fixed. Even more particularly, this invention relates to opaque, removable protective backing layers that can be conveniently used without altering the sensitometric characteristics of the photographic element coated on the opposite side of the support.

2. Description of the Prior Art

The addition of so-called "backing layers" to one side of a film support containing a photographic silver halide layer coated on the other side of the support, is well-known in the art. These layers are applied for various reasons. They are applied as anti-halation layers, anti-friction layers, anti-static layers and protective layers, for example. Carbon black is sometimes incorporated as an opacifying agent for anti-halation purposes, as described in U.S. Pat. No. 2,271,234, or for providing an opaque backing layer for diffusion transfer type photographic elements, whereby a reusable negative can be obtained, as explained in U.S. Pat. No. 3,677,790. U.S. Pat. No. 3,511,660 points out, however, that carbon black has a deleterious effect on the sensitometric properties of the photosensitive silver halide layer of photographic film. This is believed to be due to sulfur and trace metal impurities present in commercial carbon black which act as fogging agents for silver halides. The problem usually occurs when the photosensitive silver halide emulsion layer comes in contact with the backing layer when the element is rolled up, in the case of a photographic film.

SUMMARY OF THE INVENTION

It is an object of this invention to provide a photographic silver halide element having an opaque backing layer without impaired sensitometric properties. Accordingly, the invention may be described as follows:

In a photographic element comprising a support having on one side a photosensitive silver halide emulsion layer and on the other side an opaque backing layer containing an opacifying agent, the improvement wherein said opaque backing layer contains a scavenging agent selected from the group consisting of fine-grain photosensitive silver halides, silver nitrate, and halides of iron, zinc and mercury.

The opacifying agent in the elements described herein is carbon black. The element may have a plurality of other layers in addition to the silver halide emulsion layer and opaque backing layer.

DESCRIPTION OF THE PREFERRED EMBODIMENTS

It has been found in accordance with the invention that the addition of small amounts of certain materials, which have been found to act as scavenging agents, to the opaque backing layer containing carbon black will prevent fog from occurring in the photosensitive silver halide emulsion layer of a photographic element. The scavenging agents of the invention are selected from ferrous and ferric halides, zinc halides, mercurous and mercuric halides, silver nitrate and fine-grain photosensitive silver halides (including chlorides, bromides, iodobromides, etc.). The silver halides are the most preferred scavenging agents. They are water-insoluble and are accordingly present as silver halide grains, which preferably have a grain size up to 0.3$\mu$. Particularly useful is photoactive, silver bromide having a grain size of about 0.06 to 0.3$\mu$. The scavenging agents are employed in amounts depending on the nature and purpose of the photographic element, including such factors as the sensitivity of the particular silver halide emulsion, the type and amount of carbon black, and the thickness of the support and any protective layers on the silver halide emulsion layer. The amount of scavenging agent employed is generally within the range of 0.01 to 50% by weight of the carbon black in the opaque backing layer. Both the carbon black and scavenging agent are dispersed or dissolved throughout the backing layer.

The carbon black is a finely divided opacifying agent prepared from incomplete combustion of natural gas or a liquid hydrocarbon and is available as channel black, furnace black and thermal black. Channel black is an amount sufficient to yield an optical density of greater than 8.0 of the backing layer when it is coated on a film support and dried is preferred.

It is particularly preferred to formulate the backing layer so that it is removable in the fluids used during the processing of the element at the step when the image is fixed. The layer contains, in addition to the carbon black and scavenging agent, a binder which is water permeable, yet not too soluble in the developing fluids. Particularly useful binder materials are the fully hydrolyzed polyvinyl alcohols (e.g., at least 99% hydrolyzed) and having a low molecular weight (e.g., a viscosity of about 4–6 centipoise, 4% aqueous solution at 20° C., as determined by the Hoeppler falling ball method). The binder is usually about 20–60% of the total mixture with 40–45% being preferred. Another useful binder is comprised of a mixture of high molecular weight (e.g., viscosity of 55 centipoise or greater) fully hydrolyzed polyvinyl alcohol and low molecular weight fully hydrolyzed polyvinyl alcohol. The high molecular weight polyvinyl alcohol may optionally be modified by copolymerization with other monomers. Another preferred mixture of binders is 98/2 high molecular weight polyvinyl alcohol/methacrylic acid copolymer and low molecular weight polyvinyl alcohol (75/25 weight mixture) wherein all the polyvinyl alcohol is at least 99% hydrolyzed. Partially hydrolyzed polyvinyl alcohol (e.g., about 85% hydrolysis) may also be used if proper crosslinking agents are also included (e.g., dimethylol urea, trimethylolmelamine, dimethylolethylene urea, triazone resins, and others well known to those skilled in the art). Still other water permeable yet cohesive binding agents that will function are gelatin, polyacrylates and copolymers thereof, partial esters of poly(methyl vinyl ether/maleic anhydride), vinylidene chloride copolymers, carboxymethyl and ethyl celluloses as well as other described in the art on formulating removable backing layers.

Adhesion promotion agents may also be used in the opaque backing layer. The layer must adhere to the element while the photosensitive layer is either unexposed or undeveloped in order to protect the system from light exposure through the support. It is preferred to use a copolymer of polyvinyl pyrrolidone/vinyl acetate (about 60/40 weight mixture) as an adhesion promoter. Based on total solids, this adhesion promoter is preferably present in concentrations from 6 to 37% by weight of the layer. Other adhesion promoters which may work within the ambit of this invention include partial esters of poly(vinyl methyl ether) and nonylphenol polyethylene oxide; polyvinyl pyrrolidone/ethyl acetate; ethylene vinyl acetate; cellulose derivates of the polysaccharides; polyvinyl acetate; and combinations of the above.

Plasticizers useful in the formulation of the backing layer include polyetherpolyol (4.5 functionality), which is preferred, glycerine, dibutylphthalate, dipropylene glycol, glycerol triacetate, sorbital, triethylene glycol diacetate, 1,2,6-hexanetroil, polyethylene glycols, and tributyl phosphate. The preferred polyetherpolyol may be added in the range of 6–20% by weight of said layer.

A surfactant such as nonylphenol polyethylene oxide is frequently employed to aid in coating the mixture on the support.

The opaque layers described herein can be coated by any of the means described in the prior art on any common photographic film support. Suitable transparent film supports include glass, cellulosic supports (e.g., cellulose acetate, triacetate, mixed esters, etc.), polymerized vinyl compounds (e.g., copolymerized vinyl acetate and vinyl chloride), polystyrene and polymerized acrylates may also be mentioned. Films formed from the polyesterification product of dicarboxylic acid and a dihydric alcohol made according to the teachings of Alles, U.S. Pat. No. 2,779,684 and the patents referred to in the specification of that patent are particularly preferred. Other suitable supports are the polyethylene terephthalate/isophthalates of British Patent No. 776,290 and Canadian Patent No. 562,672 and those obtained by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al U.S. Pat. No. 3,052,543 may also be used. The above mentioned polyester films are particularly suitable because of their dimensional stability and the opaque backing layers of this invention may be particularly balanced to perform the function described on the support films. It is not necessary to this invention to have a removable opaque backing if that function is not desired and thus these novel non-fogging opaque layers may be coated on any suitable photographic film support. By carefully adjusting the backing ingredients (e.g., binders, plasticizers, adhesion promoters and wetting agent), these layers may be prepared so as to adhere to any of the supports disclosed in the prior art.

In the most preferred embodiment of the invention, wherein the opaque backing layer is removable, it will adhere to the film support during exposure and development but will strip away when soaked in water or a salt solution (e.g., sodium sulfite) used for stabilizing the exposed and developed image.

The invention will now be illustrated by the following examples:

EXAMPLE 1

The following opaque backing solution was prepared from the following materials:

| | |
|---|---|
| polyvinyl alcohol mixture* (10% aqueous solution) | 800 gm. |
| Carbon Black | 3200 gm. |
| Plasticizer (Voranol RN485, a polyetherpolyol with a 4.5 functionality Dow Chemical Co. - 50% aqueous solution) | |
| Polyvinyl pyrrolidone/vinyl acetate copolymer (60/40) | 1600 gm. |

*75/25 mixture of high molecular weight (viscosity = 55 c.p. or greater, 4% soln. in water at 20° C., Hoeppler falling ball method), fully hydrolyzed (99% hydrolysis or greater) polyvinyl alcohol (of the type disclosed in U.S. Pat. 3,689,469) and low molecular weight (viscosity = 4–6 c.p.), fully hydrolyzed polyvinyl alcohol.

This slurry was well mixed for about 30 minutes and had a 14.8% solids level and a measured viscosity of 470 c.p. The following two solutions were then prepared:

| | |
|---|---|
| (A) | |
| Polyvinyl alcohol mixture* (10% aqueous solution) | 500 gm. |
| Distilled Water | 1000 g. |
| 0.3M KBr solution | 55 ml. |
| Temp. = 100° F., stirred together 15 min. | |
| (B) | |
| Distilled Water | 1400 ml. |
| 0.3M $AgNO_3$ solution | 50 ml. |

Using red safelight (photographic) conditions, solution B was added to solution A within 30 seconds and the resulting mixture was stirred for 15 minutes. While still maintaining the red safelight conditions, aliquots of the A-B mixture were added to 3300 gm. portions of the opaque backing solution described above as shown below:

| Portion | 1 | 2 | 3 | 4 | 5 |
|---|---|---|---|---|---|
| Amount of A-B added (ml.) | 0 | 75 | 150 | 300 | 600 |

After the A-B mixture had been thoroughly mixed into the opaque backing solution, it was considered "safe" to use "white lights." These solutions were then coated on 0.004 inch thick polyethylene terephthalate film which had been biaxially stretched (oriented) and heat relaxed. After coating and drying, these coatings were tested to see if they would affect the sensitometry of a photographically sensitive silver halide emulsion layer. This test was accomplished by placing the opaque backing layer in intimate contact with the emulsion layer within a light-tight envelope and placing the envelope in a 120° F. oven for about 3 days. As a control, a film containing a gelatin anti-curl layer was placed in intimate contact with the silver halide emulsion layer of another piece of film containing the same photographic element described above in the same environment. At the end of this period, the samples of photographic film were developed in a standard developer for that particular element and the fog level determined. In the case of the opaque backing layer containing no A-B solution, the fog was four times greater than the control while all of the samples containing varying amounts of A-B solution were equal to or better than the control in respect to fog level. Additionally, these backing layers, which had an optical density of more than 8.0, adhered well to the polyester support film over a wide range of temperatures and humidities (−10° F. to 170° F. and 0% RH to 90% RH). However, when soaked in water or water containing salts such as $Na_2SO_3$, the layer was removed in less than 60 seconds as a single sheet that could be easily removed from the solution. No particles of backing layer were left to contaminate said solution. When this experiment was repeated without the use of red safelights (i.e., preparing a non-photographically active silver bromide mixture) the opaque backing prepared therefrom produced fog when contacted with a photosensitive emulsion layer. Thus it can be seen that for a silver halide to act as a scavenger in our novel opaque backing layer it itself must be photosensitive.

EXAMPLE 2

An opaque backing solution similar to that described in Example 1 was prepared. Photographically active silver bromide prepared as described in Example 1 was added to this backing solution so that approximately 0.11 gm. AgBr was present for every pound of solids in the backing solution. After the backing solution plus the AgBr had been thoroughly mixed, it was coated on the unsubbed side of 0.004 inch thick biaxially stretched (oriented) and heat relaxed polyethylene terephthalate film base which had been subbed on one side with a conventional vinylidene chloride/alkyl acrylate/itaconic acid copolymer, over which had been coated a thin anchoring substratum of gelatin (about 0.5 mg/dm$^2$). A gelatin silver halide emulsion prepared from an ammonical silver iodobromide solution (about 3 mole % AgI and about 97 mole % AgBr), digested at elevated temperatures with gold, sulfur and a panchromatic sensitizing dye, was then coated on the subbed side of the film base to a coating weight of about 30 mg. silver halide/dm$^2$. A thin overcoating of hardened gelatin was placed thereon at about 10–15 mg. gelatin/dm$^2$. The emulsion also contained the usual hardeners, antifoggants, wetting agents, etc., well-known to those skilled in the art. After drying thoroughly, a sample strip of this material was rolled tightly to simulate roll film for a camera, for example. In this configuration, the opaque backing layer was in intimate contact with the silver halide emulsion layer. For a control, an element similar to that described above but without the photographically active silver bromide in the opaque backing layer was also prepared and rolled in a similar manner. Both samples were stored 5 days in an oven at about 120° F. Samples from both rolls were then exposed to a 100 watt tungsten lamp at a distance of 5 feet through a $\sqrt{2}$ step wedge for about 1/100 second and developed in a standard negative developer. After fixing, the element was soaked in aqueous sodium sulfite solution, washed 3–4 minutes in running water and the following sensitometry obtained:

| Sample | Speed | Slope | D Max | Base & Fog |
|---|---|---|---|---|
| Control-No AgBr | 73 | .64 | 1.53 | .31 |
| in backing layer containing AgBr | 83 | .68 | 1.56 | .23 |

Both samples produced a high resolution negative element, since the backing layer was removed by soaking in about 12% aqueous sodium sulfite at about 70° F. for about 60 seconds. Additionally, the backing layer came off easily in one large piece that could be removed from the sodium sulfite solution without contaminating same. The element of this invention exhibits improved aging stability, especially with respect to fog.

EXAMPLE 3

The following solution was prepared:

| | |
|---|---|
| Distilled Water | 776 gm. |
| Mercuric Chloride | 84 gm. |

This material was stirred at room temperature until all the mercuric chloride crystals had dissolved. An oqaque backing layer similar to that shown in Example 1 was prepared and split into 3 portions of 3300 gms. each. To the 1st portion 100 ml. of the above solution was added, 200 ml. to the 2nd portion and 400 ml. to the 3rd portion. Each portion was stirred thoroughly and then coated on polyethylene terephthalate film base as described in Example 1. Samples of the coated and dried film were tested for fogging effects on a silver halide emulsion as described in Example 1. Only the two samples containing the higher amounts of mercuric chloride approached the control (gel backing layer) in fog levels although all samples showed lower fog levels than an opaque backing layer without the mercuric chloride scavenging agent.

EXAMPLE 4

In a like manner to that described in Example 2, 1% ferrous chloride and 1% zinc chloride solutions in distilled water were prepared. Varying amounts from 0.1 gm. to 0.8 gm. of zinc chloride and from 0.25 gm, to 2.0 gm. of ferrous chloride were added to 3300 gm. aliquots of opaque backing solutions prepared as described in Example 1. These were coated and tested as described therein. Although none of the samples tested were as effective as the control (gel backing) all were lower in fog than an opaque backing layer without a scavenging agent incorporated therein indicating that both zinc and ferrous chloride are effective as scavengers.

The impurity scavenging agents described in this invention are useful within any backing layer which might contain impurities deleterious to the sensitometry of an adjoining silver halide element and which might come in contact with the backing layer during handling and transportation. These impurities (e.g., sulfur, trace metals, etc.) are usually present within the carbon black itself. The scavenging agents thus react with and tie up the impurities before they can create a sensitometric problem.

What is claimed is:

1. In a photographic element comprising a support having on one side a photosensitive silver halide emulsion layer and on the other side an opaque backing layer containing a carbon black opacifying agent and a scavenging agent, the amount of scavenging agent being within the range of 0.01–50% by weight of the carbon black in the opaque backing layer, the improvement wherein said scavenging agent is a fine-grained photosensitive water-insoluble silver halide.

2. The photographic element of claim 1 wherein said scavenging agent is selected from a group consisting of silver chloride, silver bromide, and silver iodobromide.

3. The photographic element of claim 2 wherein said scavenging agent is silver bromide.

4. The photographic element of claim 1 wherein said scavenging agent has a grain size up to 0.3 microns.

5. The photographic element of claim 1 wherein said opaque backing layer contains a binder comprising a polyvinyl alcohol, and wherein the support is a polymeric film.

6. The photographic element of claim 1 wherein said opaque backing layer contains a copolymer of polyvinyl pyrrolidone and vinyl acetate.

7. The photographic element of claim 1 wherein said opaque backing layer contains from 6–20% by weight of a polyetherpolyol.

8. The photographic element of claim 1 wherein said opaque backing layer is removable when treated with an aqueous solution.

9. The photographic element of claim 1 wherein said support is a transparent polyethylene terephthalate film.

* * * * *